US010780405B2

(12) United States Patent
Poul et al.

(10) Patent No.: US 10,780,405 B2
(45) Date of Patent: Sep. 22, 2020

(54) LIQUID DISPENSING AND AERATING SYSTEM

(71) Applicant: Wine Accents, LLC, Duluth, MN (US)

(72) Inventors: Gregory Poul, Mahtomedi, MN (US); Thomas Wendt, Colfax, WI (US)

(73) Assignee: Wine Accents, LLC, Duluth, MN (US)

( * ) Notice: Subject to any disclaimer, the term of this patent is extended or adjusted under 35 U.S.C. 154(b) by 231 days.

(21) Appl. No.: 16/031,780

(22) Filed: Jul. 10, 2018

(65) Prior Publication Data

US 2019/0009226 A1 Jan. 10, 2019

Related U.S. Application Data

(60) Provisional application No. 62/530,820, filed on Jul. 10, 2017.

(51) Int. Cl.

| | |
|---|---|
| ***B01F 3/04*** | (2006.01) |
| ***B65D 47/32*** | (2006.01) |
| ***B67D 3/00*** | (2006.01) |

(52) U.S. Cl.

CPC ..... *B01F 3/04744* (2013.01); *B01F 3/0446* (2013.01); *B65D 47/32* (2013.01); *B67D 3/0051* (2013.01); *B01F 2215/0072* (2013.01)

(58) Field of Classification Search

CPC .... B65D 47/068; B65D 47/32; B67D 3/0051; B67D 3/00; B01F 3/0446; B01F 5/0428

USPC ..... 99/323.1, 277.1; 261/76, DIG. 75; 222/566, 567

See application file for complete search history.

(56) References Cited

U.S. PATENT DOCUMENTS

| | | | | | |
|---|---|---|---|---|---|
| 2,662,670 | A * | 12/1953 | Voight | B65D 47/32 | 222/478 |
| 5,961,008 | A * | 10/1999 | Peckels | B65D 39/06 | 222/477 |
| 6,568,660 | B1 * | 5/2003 | Flanbaum | B65D 47/06 | 222/189.07 |
| 8,365,964 | B2 * | 2/2013 | Federighi | B01F 3/0446 | 222/190 |
| 8,517,350 | B2 * | 8/2013 | Tsai | B01F 5/0428 | 222/190 |
| 8,727,324 | B2 * | 5/2014 | Borden | B01F 5/0428 | 222/190 |
| 9,033,187 | B2 * | 5/2015 | Luebke | B01F 3/0446 | 222/190 |
| 2012/0056339 | A1 * | 3/2012 | Chiorazzi | B01F 13/002 | 261/76 |
| 2012/0156345 | A1 * | 6/2012 | Agarwal | B01F 5/0428 | 426/474 |
| 2015/0068406 | A1 * | 3/2015 | Marsden | C12H 1/14 | 99/323.1 |
| 2016/0051069 | A1 * | 2/2016 | Turner | B65D 47/32 | 222/567 |
| 2018/0014673 | A1 * | 1/2018 | Wert | B65D 21/0233 | |

* cited by examiner

*Primary Examiner* — Reginald Alexander
(74) *Attorney, Agent, or Firm* — Skaar Ulbrich Macari, P.A.

(57) ABSTRACT

A liquid dispensing device and system to dispense, or aerate and dispense a liquid such as wine through a spout. The dispensing device having multiple air ports and aeration chambers to form multiple aerating segments during the pour process. The dispensing device having a handle to increase grasping of a liquid container and preventing accidental separation of the device and a container.

18 Claims, 7 Drawing Sheets

LIQUID DISPENSING AND AERATING SYSTEM

PRIORITY

This Application claims priority to and the benefit of U.S. Provisional Application No. 62/530,820, filed on Jul. 10, 2017, which is hereby incorporated herein by reference in its entirety.

BACKGROUND OF THE INVENTION

The present invention relates generally to a liquid delivery device, and more particularly, the present invention relates to a new and novel liquid delivery device that prevents the accidental spilling of liquids and the dropping of liquid containers.

Liquid delivery devices and systems have traditionally consisted of pourers, spouts, and aerators that are removably inserted into a neck of a bottle such as spirits or wine bottles. These delivery devices typically have a stopper, with or without externally radiating fins, which engage an inner surface of the neck of the bottle to prevent the separation of the liquid delivery device from the liquid container. The stopper typically has a fluid channel extending through it to permit the passage of a liquid, such as wine, to escape the container when the container is generally inverted during the pouring process.

While the typical pourers, spouts, and aerators function adequately they do have the short coming of relying on passive friction to maintain the liquid dispenser in the neck of the bottle or container. This passive friction permits occasional separation of the liquid dispenser from the liquid container causing the liquid to be spilled. Another short coming of the traditional liquid dispensers is that in order to dispense a liquid such as wine from a container, a user typically handles just the liquid container or presses on a stem or spout of the delivery device. Liquid containers often have smooth surfaces due to the common use of glass and plastics during the manufacturing process. In bar and restaurant settings a server's hands often encounter slippery substances such as water from washing glasses and mixing drinks, and grease from handling dinnerware. When a server's hands encounter these slippery substances it is possible for a liquid container to slip from their hand causing the liquid dispenser to separate from the container or causing the container to break wasting the liquid contents.

While the traditional liquid delivery devices are adequate in achieving their purpose, they fail to provide a new liquid delivery device that prevents the aforementioned short comings while also permitting aeration of the liquid being poured.

BRIEF SUMMARY OF THE INVENTION

A liquid dispensing device and system to dispense, or aerate and dispense a liquid such as wine through a spout is disclosed herein. The dispensing device may have one or more aeration chambers and one or more ports to form multiple aerating segments during the pouring process. The dispensing or liquid dispenser may have a handle to increase grasping of a liquid container or bottle and preventing accidental separation of the dispenser and a container.

The liquid dispensing device and system of the present invention also includes a channel or groove permits air to enter an interior of the container holding the liquid. As the air enters the container it enables the liquid contained therein to more easily flow of of the bottle. In one embodiment of the invention, the channel can be partially covered by a seal member that forms one or more open ends in the channel.

In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

Figure 1:
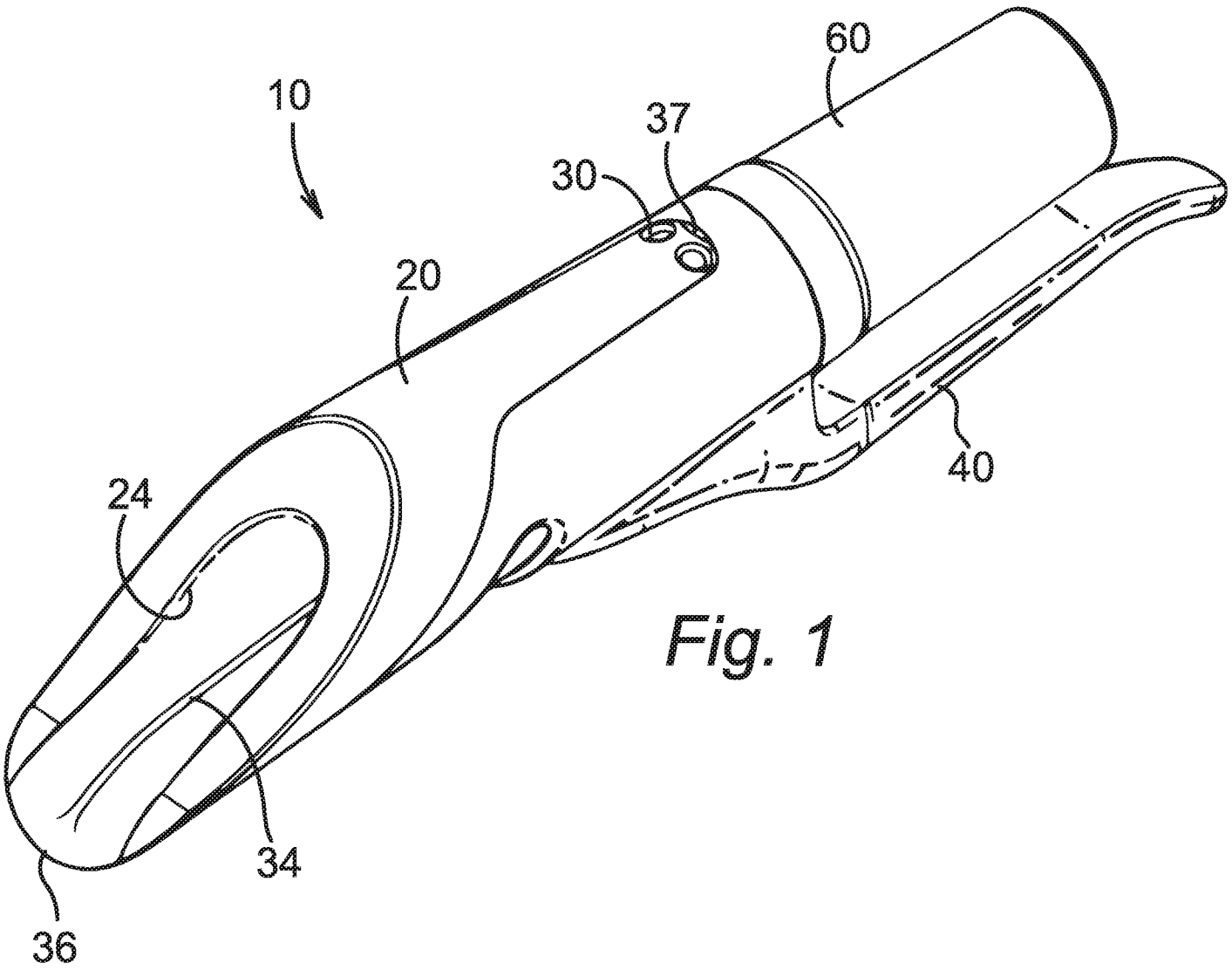
FIG. 1 is a perspective view of a liquid dispenser according to the present invention.

While the invention is amenable to various modifications and alternative forms, specifics thereof have been shown by way of example in the drawings and will be described in detail. It should be understood, however, that the intention is not to limit the invention to the particular example embodiments described. On the contrary, the invention is to cover all modifications, equivalents, and alternatives falling within the spirit and scope of the invention as defined by the appended claims.

DETAILED DESCRIPTION OF THE INVENTION

In the following descriptions, the present invention will be explained with reference to example embodiments thereof. However, these embodiments are not intended to limit the present invention to any specific example, embodiment, environment, applications, or implementations described in these embodiments. Therefore, description of these embodiments is only for purpose of illustration rather than to limit the present invention. It should be appreciated that, in the following embodiments and the attached drawings, elements unrelated to the present invention are omitted from depiction; and dimensional relationships among individual elements in the attached drawings are illustrated only for ease of understanding, but not to limit the actual scale.

Referring generally to FIGS. 1-11, a liquid dispenser device and system 10 is designed to be removably inserted into an opening of a neck of a liquid container such as a bottle of liquor, wine, or spirits. As particularly illustrated in FIG. 1, the liquid dispenser 10 includes a spout 20 that is designed to direct a flow of liquid out of the liquid container. The spout 20 may include a handle 40 extending from a portion of the spout 20. The handle 40 is designed to be grasped by a user to ensure that the liquid dispenser 10 does not separate from the liquid container. The liquid dispenser 10 also includes a gasket or stop 60 that is adapted to removably secure the spout 20 in fluid communication within the liquid container.

Figure 2:
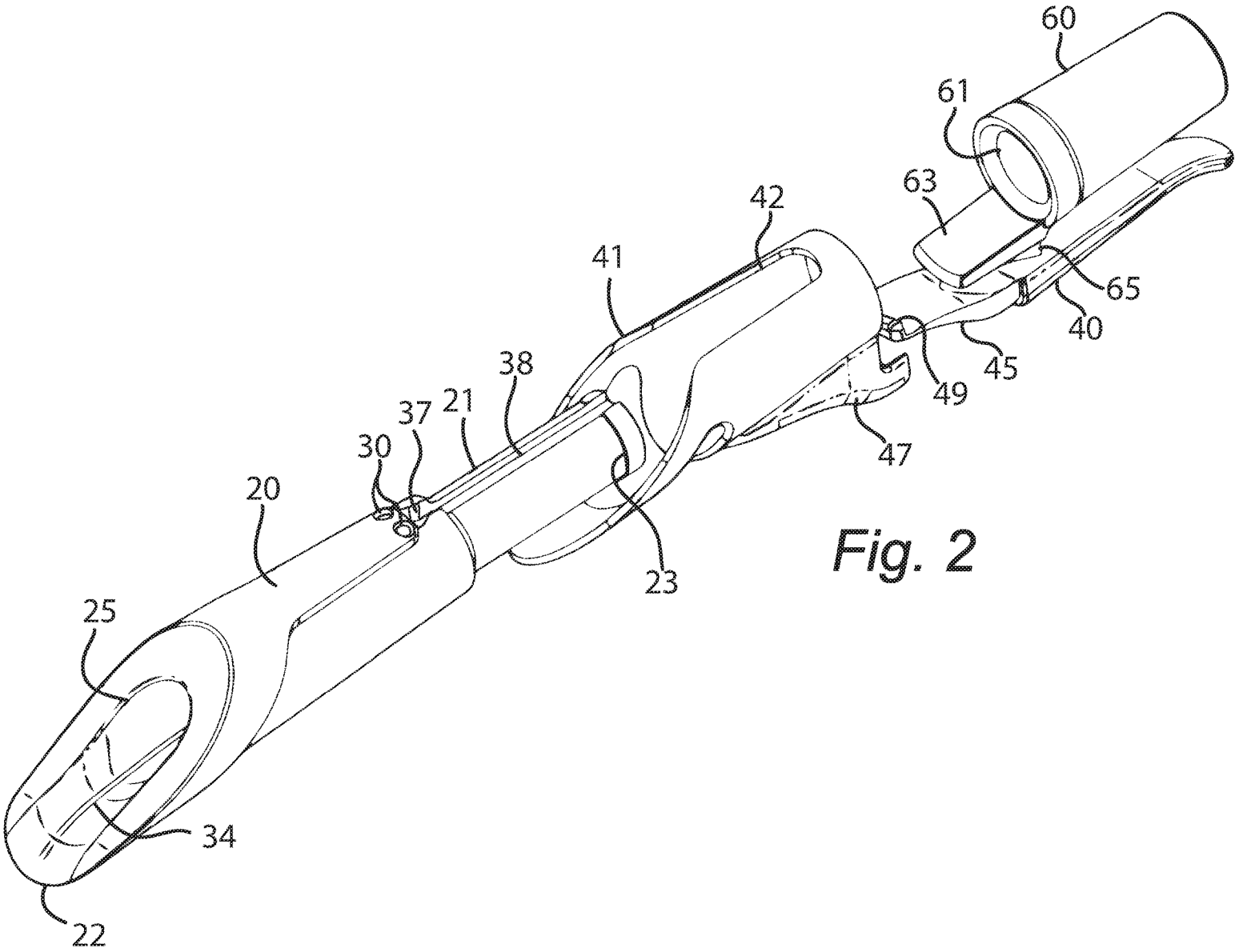
FIG. 2 is an exploded perspective view of a liquid dispenser according to the present invention.

As illustrated in FIGS. 1 and 2, the spout 20 may include a stem portion 21 generally opposite a free pour end 22 of the spout 20. The stem portion 21 is adapted to be removably inserted into a neck of a liquid container to act as a conduit for the liquid in the container. The stem portion 21 is adapted to be received within at least a portion of a passage way 61 extending through the stop 60. In one example embodiment, the stem portion 21 may have a length greater than or less than a length of the stop 60. In another example embodiment, the stem portion 21 may have a reduced outer diameter to permit an outer surface of the stop 60 to be generally flush with an outer surface of the spout 20.

In one example embodiment, as particularly illustrated in FIG. 2, the stem portion 21 may include a lip 23 proximate a free end thereof that may be adapted to retain the stop 60 to the stem portion 21. In another example embodiment, the lip 23 may exert pressure on an inner surface of the stop 60 thereby sealing the abutment or interface between the stem portion 21 and the stop 60. In still another example embodiment, the stop 60 may be fixed to at least a portion of the stem portion 21 by pressure fitting, food grade adhesive, threading, and the like.

Figure 3:
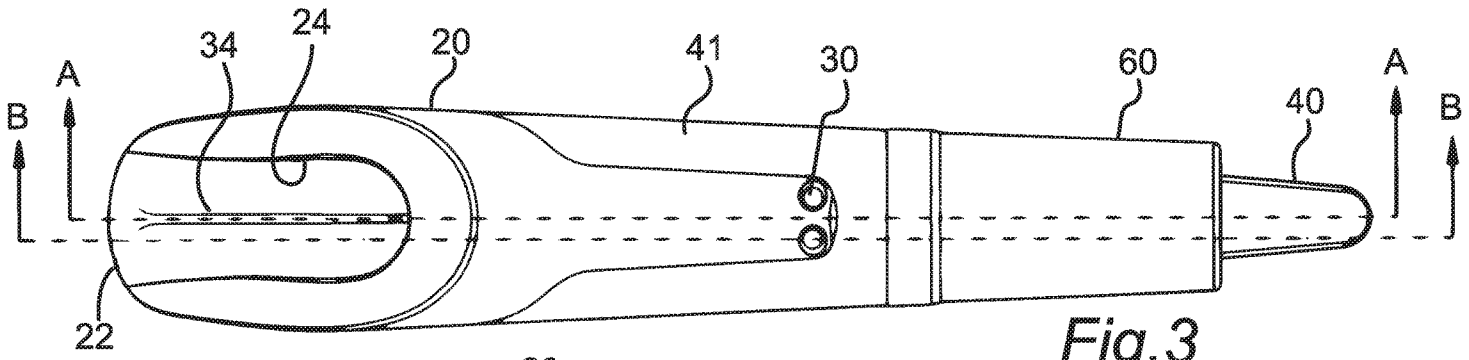
FIG. 3 is a top view of a liquid dispenser according to the present invention.
Figure 4:
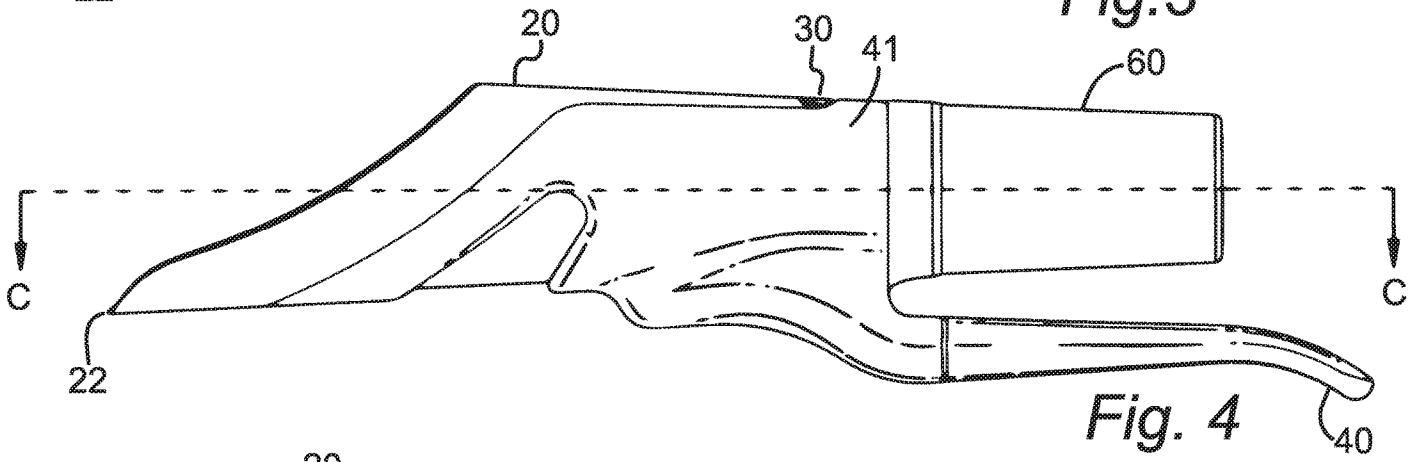
FIG. 4 is a side view of a liquid dispenser according to the present invention.
Figure 5:
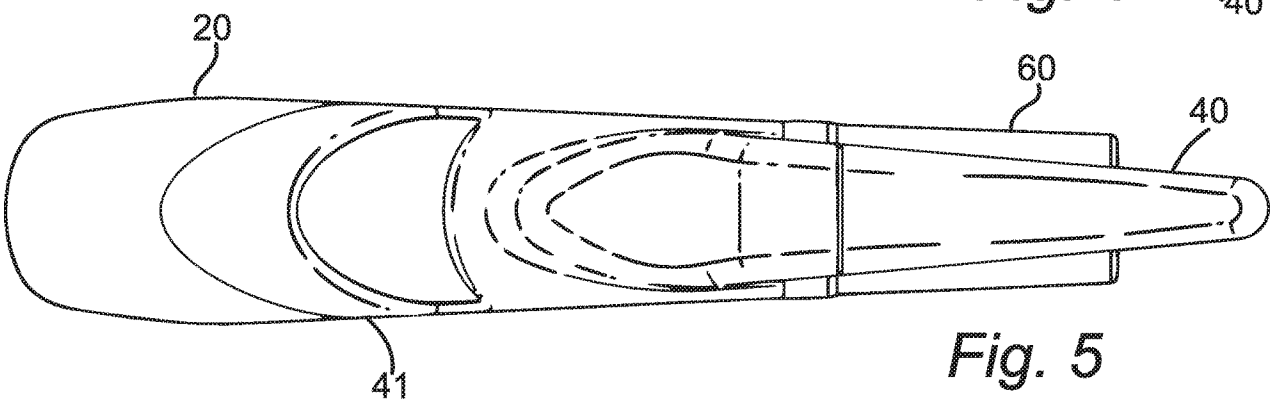
FIG. 5 is a bottom view of a liquid dispenser according to the present invention.

Referring now to FIGS. 1-3, the free pour end 22 of the spout 20 may include an outlet opening 24 that extends into a channel 25 that may extend generally in a longitudinal axis through the spout 20. The outlet opening 24 may be formed in the spout 20 by removal of an upper portion of the spout 20 such that a portion of channel 25 has an open top. As illustrated in FIG. 1, outlet opening 24 may be generally oriented at an angle to a long axis of the spout 20. The particular orientation of the outlet opening 24 forms generally tapering side walls from a top of the spout 20 toward the free pour end 22 of the spout 20. The tapering side walls act to retain the liquid during the pouring operation. Other configurations are also contemplated herein and should be considered to be within the spirit and scope of the invention.

The channel 25 defines a path or conduit for a flow of the liquid out of the liquid container. As particularly illustrated in FIGS. 6 and 7, the channel 25 extends through an inlet opening 27 in the stem portion 21. In one embodiment of the invention, as particularly illustrated in FIG. 7, the channel 25 forms a lower wall surface 28*a*, an upper wall surface 28*b*, and generally opposed side wall surfaces 28*c* and 28*d*.

Figure 6:
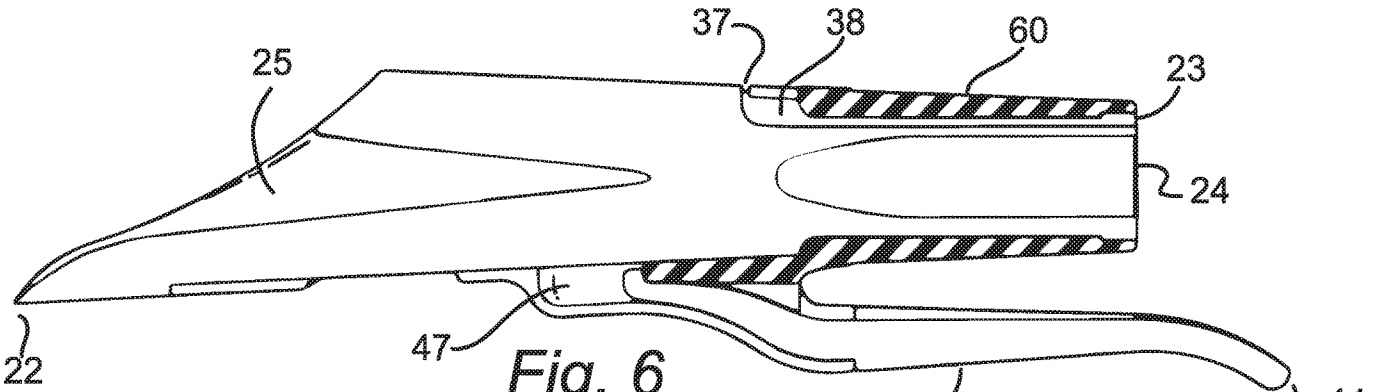
FIG. 6 is a cross sectional view along lines A-A of FIG. 3.
Figure 7:
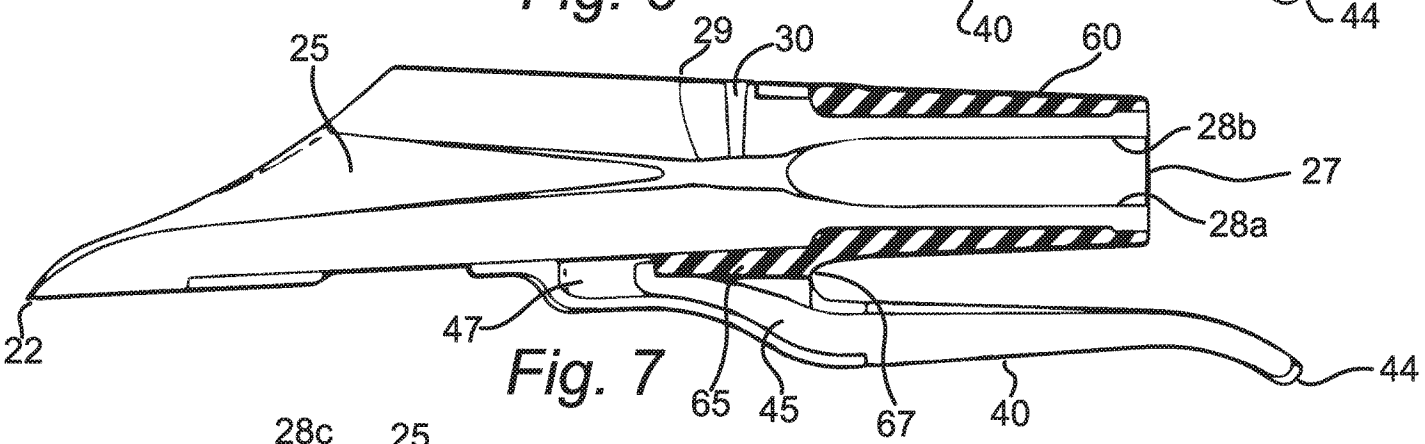
FIG. 7 is a cross sectional view along lines B-B of FIG. 3.

In some embodiments of the present invention, the liquid dispenser 10 may be adapted to aerate the liquid flowing through the channel 25. As illustrated in FIG. 7, the channel 25 may include an aeration segment or chamber 29. The aeration chamber 29 may be defined by a general narrowing in a portion or a segment of the channel 25. As illustrated in FIG. 6, the channel 25 may have a larger inner diameter at an end of stem portion 21 and then generally taper or narrow toward a mid portion of the liquid dispenser 10 or spout 20. In one embodiment of the invention, the inner diameter of the channel 25 may open or increase from a portion of the narrow aeration segment or chamber 29 toward the pour end 22 of the spout 20.

As particularly illustrated in FIG. 7, the liquid dispenser 10 may include one or more ports 30 extending into the spout 20 to inject, infuse or to permit the passage of air into the liquid as it flows through the channel 25 of the spout 20. The ports 30 may be in fluid communication with aeration chamber 29 or with any other portion of the channel 25. As liquid flows through the channel 25 it may accelerate as it travels through the chamber 29. This movement of the liquid draws air or another gas into the aeration chamber 29, thereby aerating or injecting micro bubbles into the flowing liquid. In one example embodiment, the ports 30 may taper from an outer surface of the spout 20 toward the aeration chamber 29. The narrowing of the port or ports 30 causes the air or gas to accelerate as it flows into the aeration chamber 29 of the channel 25. The dual or simultaneous acceleration of the liquid flowing through the aeration chamber 29 and the port or ports 30 significantly increases the aeration process.

Figure 8:
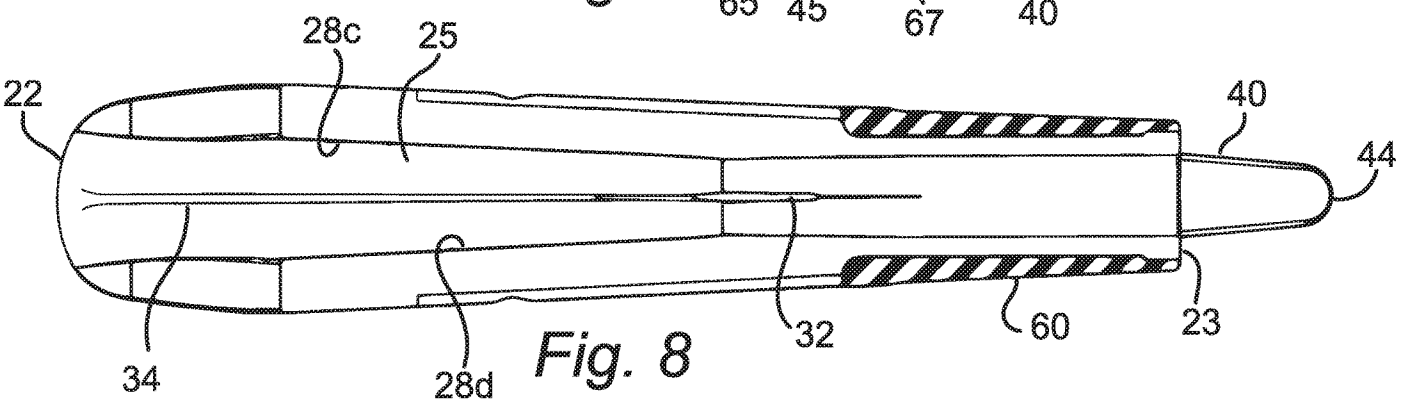
FIG. 8 is a cross sectional view along lines C-C of FIG. 4.
Figure 9:
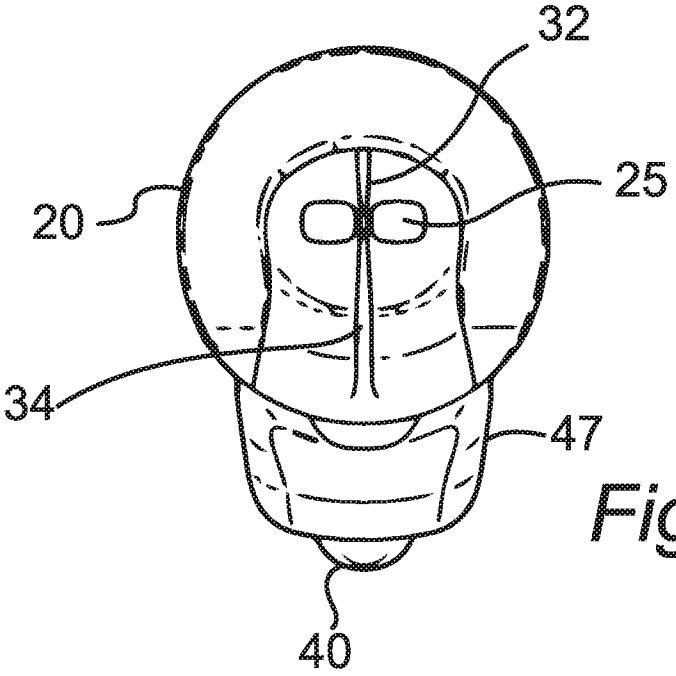
FIG. 9 is an end view of a liquid dispenser according to the present invention.
Figure 10:
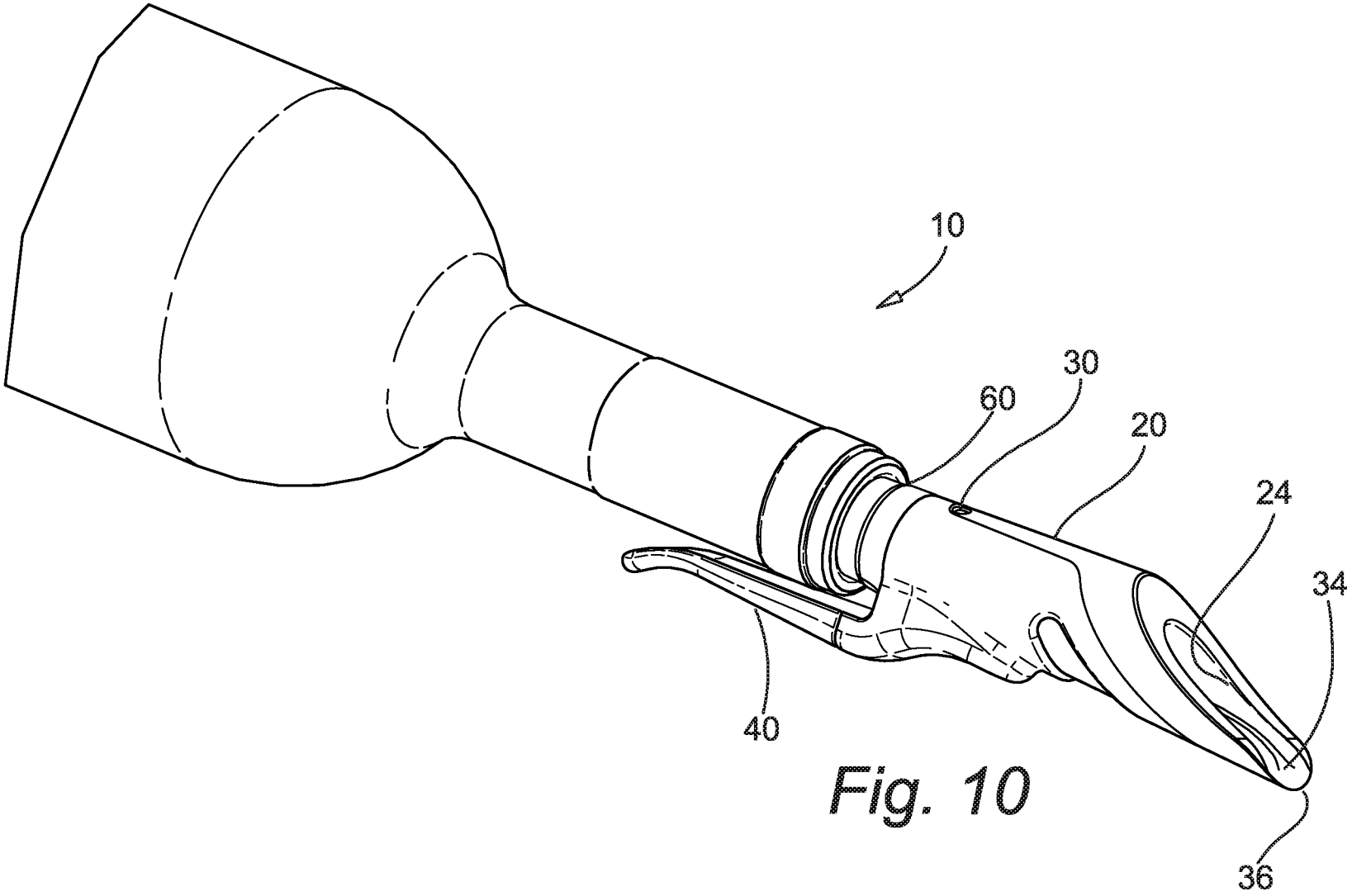
FIG. 10 is a perspective view of a liquid dispenser according to the present invention.

In one example embodiment of the invention, as particularly illustrated in FIG. 8, the aeration chamber 29 may be divided into one or more sub-channels by a wall 32 formed or positioned therein. A width or thickness and the height of the wall 32 may generally increase or decrease along its length and/or height such that the wall 32 further narrows or widens the sub-channels in the aeration chamber 29 and thus further increasing or decreasing the flow of liquid therethough. The wall 32 also acts as a blade or fin causing turbulence and cavitation within the liquid flowing through channel 25. The turbulence acts to accelerate the aeration process.

In another example embodiment of the invention, as particularly illustrated in FIG. 8, lower wall surface 28*a* may have a lip or ridge 34 formed therein that extends along at least a portion of the length of the spout 20. The lip 34 may be connected to a portion of the wall 32 to assist in directing a flow of liquid toward the pour end 22 during the pouring operation. The lip 34 further continues the aeration process by creating additional turbulence or mixing of the liquid flowing over lip 34 as it travels toward the free pour end 22. As the liquid approaches the free pour end 22, the lower wall surface 28*a* may curve in a generally downward direction toward free pour end 22. Also, a thickness of lower wall surface 28*a* may decrease toward free pour end 22 to form a sharp edge 36 that controls and prevents dripping of the liquid as the container is moved from the inverted position to its upright position.

As briefly described above, liquid dispenser 10 may include a handle 40 that permits a user to simultaneously grab the liquid dispenser 10 and the liquid container, thereby preventing their accidental separation. In one example embodiment, the handle 40 may be formed into or onto a portion of the spout 20.

In another example embodiment, as particularly illustrated in FIGS. 2 and 6-8, the handle 40 may include a cradle portion 41 adapted to be coupled to or to receive at least a portion of the spout 20. Cradle portion 41 may function to provide additional support to the spout 20. Cradle portion 41 may be manufactured from any material, such as any synthetic, semi-synthetic, or natural materials. As illustrated in FIG. 2, cradle portion 41 may include a recess 42 formed in its wall to receive a portion of spout 20. The fitting of spout 20 within the recess 42 may prevent rotational movement of spout 20.

As illustrated in FIGS. 1-2 and 6-7, a portion of the handle 40 may extend away from and generally parallel to a long axis of the spout 20. A free end 44 of the handle 40 may extend beyond an end of the stem portion 21 to optionally enable the handle 40 to engage a portion of the liquid container. Referring to the example embodiments of FIGS. 2 and 6-7, the handle 40 may have a tongue portion 45 extending therefrom that is insertable into an opening, cavity or mouth 47 formed on the cradle portion 41 of the handle 40. The handle 40 may be replaced with handles of various sizes and shapes for style purposes or to accommodate liquid containers of various shapes. The handle 40 may also have a design that permits it to abut, engage, or releasably couple to a portion of the container.

In one example embodiment, the handle 40 is adapted to prevent the stop 60 from pivoting or moving within the neck of the liquid container in order to further prevent accidental separation of the liquid dispenser 10 and the liquid container. As particularly illustrated in FIGS. 2 and 6-7, stop 60 includes an arm 63 that extends generally in axial direction from an edge of the side wall of the stop 60. Referring to FIGS. 6 and 7, the arm 63 may be adapted to be positioned between the tongue portion 45 of the handle 40 and the stem portion 21 of the spout 20. As illustrated in FIG. 2, the tongue portion 45 may have a lipped end 49 adapted to engage an edge of the arm 63.

Figure 11:
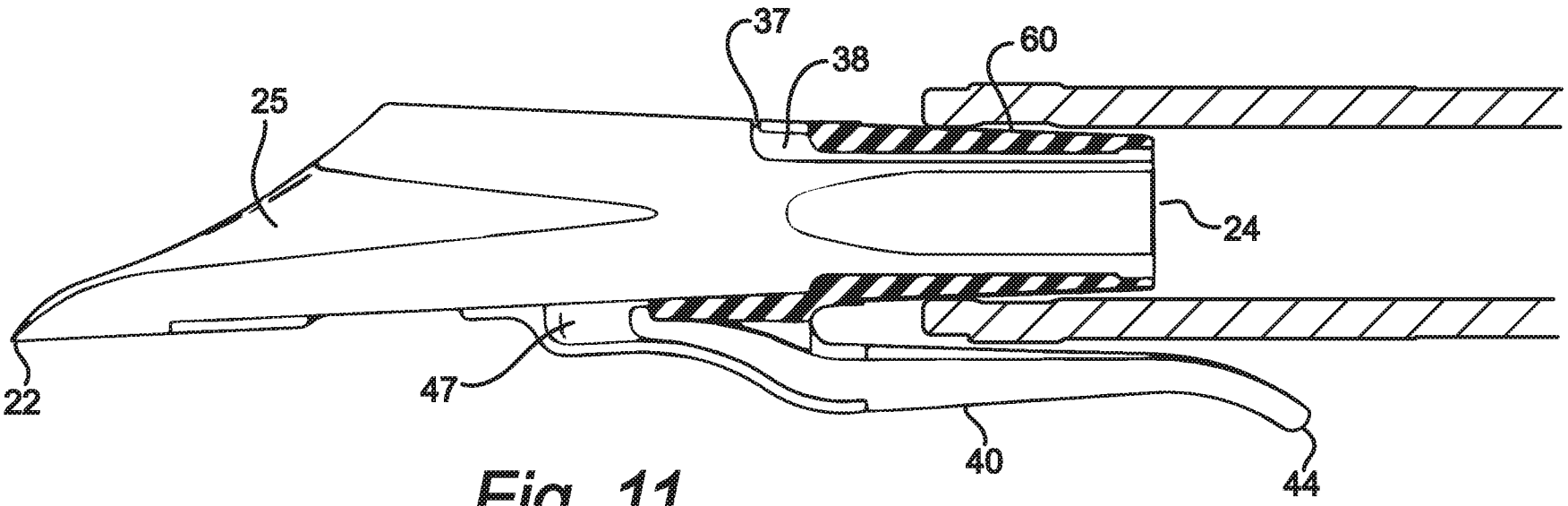
FIG. 11 is a cross-sectional view of a liquid dispenser according to the present invention.

Referring back to FIG. 2, the arm 63 may include one or more flanges, fins or a wedges 65 that are adapted to engage a surface of the tongue portion 45. The fins 65 may act as a spring or cushion to bias the handle 40 generally away from the liquid container. In another example embodiment, as particularly illustrated in FIG. 7, the fins or wedge 65 may have an edge 67 that is generally orthogonal to a long axis of the stop 60. As illustrated in FIG. 11, edge 67 may have a generally concave curvature that permits it to abut and, optionally, form to an edge or lip of the liquid container when the stop 60 is inserted into the container. The edge 67 acts to cushion the engagement of liquid dispenser 10 with an edge of the container. The edge 67 may further act to create friction between liquid dispenser 10 and the container in order to prevent rotation of liquid dispenser 10 in the container.

Stop 60 and its fins 65 may be composed of similar or dissimilar materials such as but not limited to rubber or cork. As particularly illustrated in FIG. 1, an outer diameter of the stop 60 may generally taper from the tongue portion 45 to a free end to assist the insertion of the stop 60 into the container. An outer surface of the stop 60 may be smooth or textured, for example with ridges, dimples, annular lips and the like, to further ensure proper engagement between the liquid dispenser 10 and the container.

In use, the stop or gasket 60 may be removably inserted into a bottle neck of a liquid container such as wine or liquor bottle. As the stop 60 is inserted, the handle 40 becomes positioned generally parallel to a long axis of the liquid container. Once the stop 60 is seated in the neck of the container it acts to seal the liquid container opening. A user may grasp the handle 40 and the liquid container together in order to generally invert the container and to dispense the liquid through the spout 20. Grasping the handle 40 and the container together provides the user with an improved handling of the container.

As the handle 40 is grasped it may pivot generally toward the liquid dispenser 10 and container. The pivoting of the handle 40 prevents movement of a long axis of the liquid dispenser 10. This non-displacement of the liquid dispenser 20 ensures that the stop 60 is not deformed and thus permitted to maintain its sealing properties.

As the container is inverted, liquid begins to flow through the liquid dispenser and into another container such as a wine glass. In example embodiments designed to aerate the liquid, the liquid enters the stem portion 21 and may be separated by the wall 32 into separate aeration chambers 29. The separation of the liquid by the wall 32 causes cavitation or turbulence of the liquid in the separate aeration chambers 29. A narrowing of the channel 25 increases a flow rate of liquid through aeration chambers 29. As the flow rate increases air is drawn into the ports 30. The narrowing of the ports 30 causes an increase in a flow rate of the air flowing therethrough. The increased flow rates of the air and the liquid causes an increased and improved aeration of the liquid before it is dispensed into a glass or another container.

In example embodiments having more than one port 30, a user may selectively close or cover one or more, or all of the ports 30 with a finger or thumb to vary the amount of aerating of the liquid. Selectively closing one or more of the ports 30 may also slow down the overall rate of the flow of the liquid through spout 20. Other portion closure mechanisms are also contemplated herein. For example, a movable collar or door structure may be operatively coupled to or formed on a portion of the liquid dispenser 10 to selectively control the amount of air flowing into the ports 30.

In some embodiments, as the aerated liquid flows through the spout 20 it may encounter the lip 34, which may cause additional turbulence, mixing, and aeration of the liquid as it flows toward the free pour end 22. As the liquid approaches the free pour end 22, the lower wall surface **28*a* may curve down toward the free pour end 22. Also, a thickness of a lower wall or portion of the spout 20, may decrease toward the free pour end 22 to form a sharp edge 36. When the liquid container is generally inverted during the pouring process the curved surface of the lower wall 28*a* may cause the adhesion of the liquid to be maintained until it reaches the sharp edge 36. Once the liquid encounters the sharp edge 36 it abruptly reduces liquid adhesion causing the liquid to be dispensed into another container such as a wine glass. The abrupt reduction in the adhesion creates a uniform pour stream thereby reducing or eliminating drips and spills. The sharp edge 36 also prevents the liquid from running down the side of the liquid dispenser 10** and the container after pouring.

The aerator embodiment uses the Venturi affect to pull air in and through the ports 30 when a liquid such as wine is poured (container inverted). As a liquid flows through the sub-channels of the aeration chamber 29 they draw in air through the ports 30 which forms micro air bubbles in the passing liquid. As the liquid or wine passes by the ports 30 the two streams of aerated liquid come together and are released into the open area or space of the spout 20. At this point, another aeration step may occur as the liquid mixes over the lip 34. Yet another aeration step may also occur as the liquid falls into and mixes together in the glass.

As wine or a liquid is poured out of the container air is permitted to flow back into the bottle or container to replace the liquid or wine leaving the bottle or container. The air is allowed back to the bottle through an inlet port 37 that is formed in the spout 20. The inlet port 37 is in fluid communication with an interior of the container via a channel or groove 38 running along a length of stem portion 21. The stop 60 may enclose the groove 38 thereby forming an air fluid tunnel or channel into the interior of the bottle or container. Alternatively, a fully enclosed tunnel or channel may be formed in and along a length of the stem portion 21. In an example embodiment of the invention, the inlet portion 37 may be positioned generally proximate the ports 30 and may be selective closed to control a flow of liquid flowing out of the container.

The invention claimed is:

1. A liquid dispensing device for dispensing a liquid from a container, the device comprising:

a spout, matable with an opening in a container, the spout having a channel extending therethrough for channeling a liquid from the container, and at least one port extending into the spout and in fluid communication with the channel for infusing air into the liquid flowing through the channel; and a handle extending away from the spout for grasping during use, wherein the spout includes a wall extending along at least a portion of the channel that divides the channel into subchannels and induces cavitation of the liquid flowing therethrough.

2. The liquid dispensing device of claim 1, wherein the channel of the spout includes a generally narrowing aeration chamber in fluid communication with the at least one port, wherein the narrowing aeration chamber is adapted to accelerate a flow of liquid being infused with air.

3. The liquid dispensing device of claim 1, wherein a circumference of the at least one port generally decreases toward the channel to permit an acceleration of air flowing therethrough and into the channel.

4. The liquid dispensing device of claim 1, wherein the wall has a height decreasing as it extends toward a lip of the spout, the decreasing height permitting the liquid to flow thereover causing turbulence of the liquid flowing out of the subchannels.

5. A liquid dispensing device for dispensing a liquid from a container, the device comprising:

a spout, having a channel extending therethrough for channeling a liquid from the container, and at least one port extending into the spout and in fluid communication with the channel for infusing air into the liquid flowing through the channel;

a stem, extending from the spout, that is removably insertable into an opening of the container, the stem having a groove formed along its length that extends at least partically into a portion of the spout, the groove being adapted to permit a flow of air into the container during a pouring process; and a stop removably positionable over a portion of the stem to seal the opening of the container, the stop is positioned to enclose a portion of the groove positioned in the spout, such that the groove has opened ends, wherein the spout includes a wall extending along at least a portion of the channel that divides the channel into sub-channels and is adapted to induce cavitation of the liquid flowing therethrough, and wherein each subchannel is in fluid communication with at least one port.

6. The liquid dispensing device of claim 5, wherein the channel of the spout includes a generally narrowing aeration chamber in fluid communication with the at least one port, wherein the narrowing aeration chamber is adapted to accelerate a flow of liquid being infused with air.

7. The liquid dispensing device of claim 5, wherein a circumference of the at least one port generally decreases toward the channel to permit an acceleration of air flowing therethrough and into the channel.

8. The liquid dispensing device of claim 5, wherein the wall has a height decreasing as it extends toward a lip of the spout, the decreasing height being adapted to permit the liquid to flow thereover causing turbulence of the liquid flowing out of the subchannels.

9. The liquid dispensing device of claim 5, further comprising a handle extending away from the spout for grasping during use.

10. The liquid dispensing device of claim 9, wherein the handle comprises a cradle portion adapted to be positioned about and supportive of a portion of the spout, the cradle portion further includes a cavity formed therein and positioned proximate an outer surface of the container for receiving an end of the handle and positioning the handle proximate the outer surface of the container.

11. The liquid dispensing device of claim 10, wherein the stop includes an arm positionable in the cavity and adapted to removably secure the end of the handle to the cradle portion.

12. A liquid dispensing system for dispensing a liquid from a container, the system comprising:

a spout having a stem that is removably insertable into an opening of the container, the spout and stem having a channel extending therethrough for channeling a liquid from the container, and the spout having at least one port extending therein and in fluid communication with the channel to infuse air into the liquid flowing therethrough; and a handle capable of being grasped by a user, the handle having a cradle portion adapted to be positioned about and supportive of a portion of the spout, the cradle portion further includes a cavity formed therein and positioned proximate an outer surface of the container for receiving an end of the handle and positioning the handle proximate the outer surface of the container.

13. The liquid dispensing system of claim 12, wherein the channel includes a generally narrowing aeration chamber in fluid communication with the at least one port, wherein the narrowing aeration chamber is adapted to accelerate a flow of liquid being infused with air.

14. The liquid dispensing system of claim 12, wherein a circumference of the at least one port generally decreases toward the channel to permit an acceleration of air flowing therethrough and into the channel.

15. The liquid dispensing system of claim 12, wherein the spout includes a wall extending along at least a portion of the channel that divides the channel into subchannels and is adapted to induce cavitation of the liquid flowing therethrough.

16. The liquid dispensing device of system 15, wherein the wall has a height decreasing as it extends toward a lip of the spout, the decreasing height being adapted to permit the liquid to flow thereover causing turbulence of the liquid flowing out of the subchannels.

17. The liquid dispensing device of system 12, wherein the stem includes a groove formed along its length that extends at least partially into a portion of the spout, the groove being adapted to permit a flow of air into the container during a pouring process.

18. The liquid dispensing device of system 17, further includes a stop removably positionable over a portion of the stem to seal the opening of the container, the stop is positioned to enclose a portion of the groove positioned in the spout, such that the groove has openings proximate the spout and an end of the stem.

* * * * *